US007708650B2

(12) United States Patent
Lloyd

(10) Patent No.: US 7,708,650 B2
(45) **Date of Patent: *May 4, 2010**

(54) GOLF SWING TRAINING DEVICE

(76) Inventor: Keith Reginald Lloyd, 1 Cook Street, Goondiwindi, Queensland (AU) 4380

( * ) Notice: Subject to any disclaimer, the term of this patent is extended or adjusted under 35 U.S.C. 154(b) by 605 days.

This patent is subject to a terminal disclaimer.

(21) Appl. No.: 11/534,247

(22) Filed: Sep. 22, 2006

(65) Prior Publication Data

US 2007/0015598 A1 Jan. 18, 2007

Related U.S. Application Data

(63) Continuation-in-part of application No. 10/549,060, filed on Sep. 13, 2005, now Pat. No. 7,513,834.

(30) Foreign Application Priority Data

Sep. 23, 2005 (AU) ..... 2005211686

(51) Int. Cl.
*A63B 69/36* (2006.01)

(52) U.S. Cl. ..... 473/266; 473/276

(58) Field of Classification Search ..... 473/207, 473/208, 252, 257, 266, 268, 274, 275, 276, 473/277

See application file for complete search history.

(56) References Cited

U.S. PATENT DOCUMENTS

| | | | | |
|---|---|---|---|---|
| 3,698,721 | A | 10/1972 | Stewart | |
| 3,703,294 | A | 11/1972 | Fitch | |
| 3,730,531 | A | 5/1973 | Zega | |
| 3,744,799 | A | 7/1973 | Hightower | |
| 3,795,399 | A | 3/1974 | Beckish | |
| 4,034,991 | A | 7/1977 | Oppenheimer | |
| 4,071,251 | A | 1/1978 | Beckish | |
| 4,211,418 | A | 7/1980 | Oppenheimer | |
| 4,583,738 | A | 4/1986 | Fava | |
| 5,039,105 | A * | 8/1991 | Ro | 473/258 |
| 6,595,865 | B2 * | 7/2003 | Stitz | 473/257 |
| 2004/0198525 | A1 * | 10/2004 | Bender | 473/207 |
| 2006/0172271 | A1 * | 8/2006 | Lloyd | 434/252 |

* cited by examiner

*Primary Examiner*—Nini Legesse
(74) *Attorney, Agent, or Firm*—Summa, Additon & Ashe, P.A.

(57) ABSTRACT

A golf swing training device comprising a first shoulder guide portion for guiding a first shoulder of a user during at least a part of a practice backswing and a second shoulder guide portion for guiding a second shoulder of a user during at least a part of a practice backswing.

21 Claims, 8 Drawing Sheets

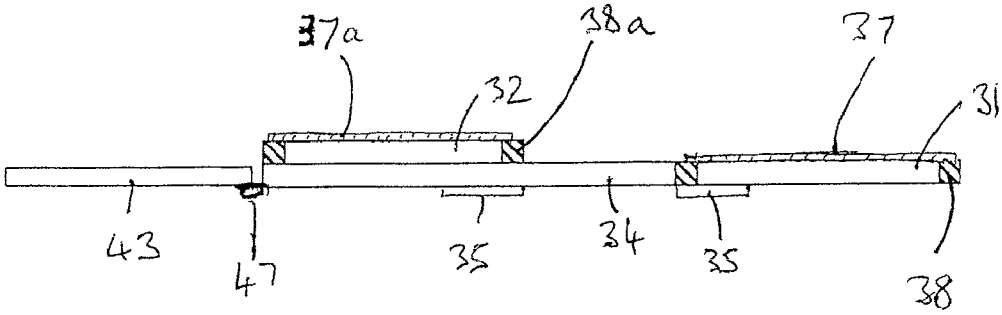
Fig. 3a
Fig. 3b
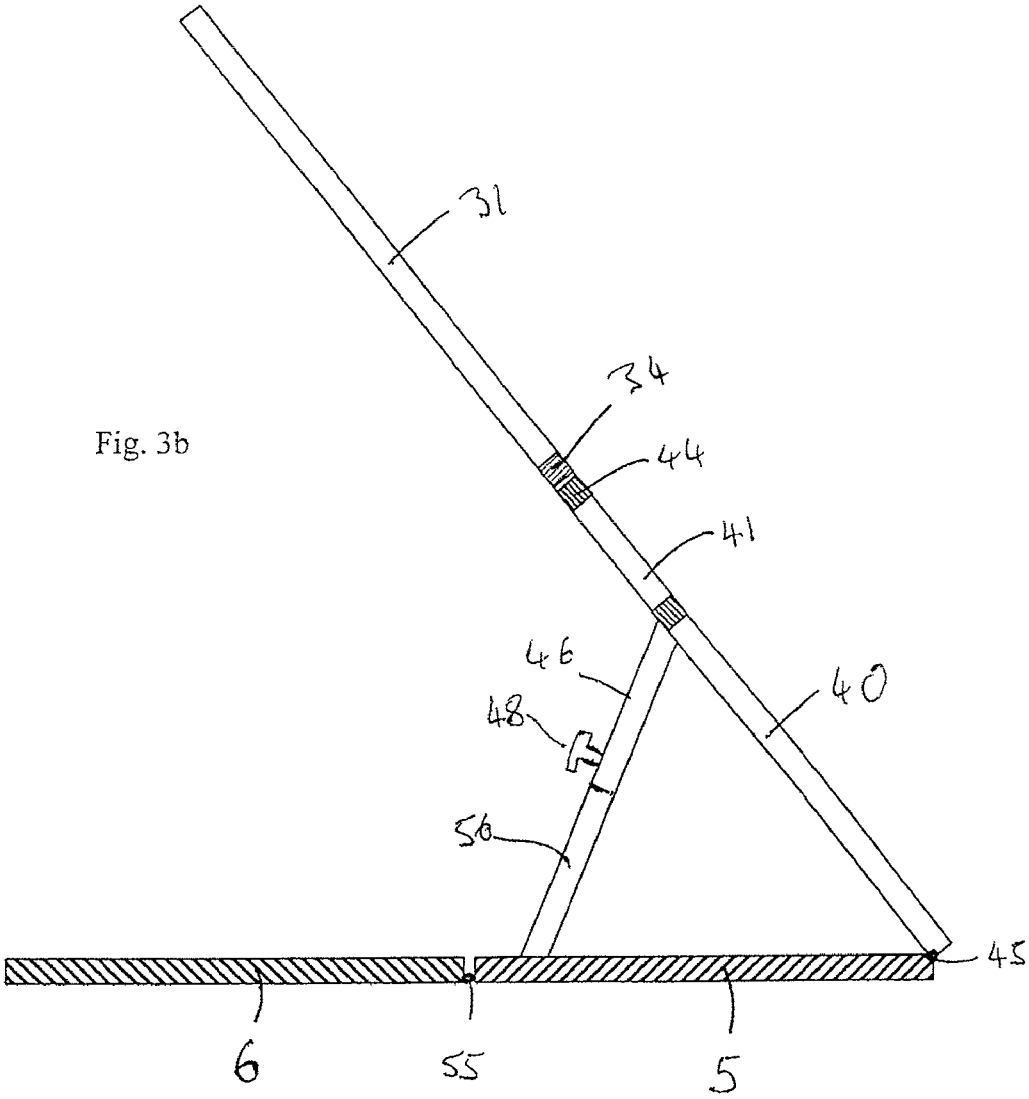

GOLF SWING TRAINING DEVICE

CROSS REFERENCE TO RELATED APPLICATIONS

This application is a continuation-in-part of prior application Ser. No. 10/549,060 which was filed Sep. 13, 2005 (and which is based on PCT Application PCT/AU2004/000304) the entire contents of which are hereby incorporated herein by reference. This application is also entitled to, and claims, convention priority from Australian patent application no. 2005211686 filed on Sep. 23, 2005, the entire contents of which are hereby incorporated herein by reference.

FIELD OF INVENTION

The present invention relates to training devices and especially to a golf swing training device.

BACKGROUND OF INVENTION

A golfer may practice his golf swing for many hours by hitting large numbers of golf balls and judging the effect on the ball to assess the proficiency of the swing. This allows the golfer to practice important aspects of the game but does not really teach the development of a correct swing. It is often stated that the correct swing should include the golf club being swung in an arc which is substantially planar and that a very important aspect in ensuring a correct swing is to have a correct backswing.

A golfer may practice his or her golf swing under the guidance of an instructor or alternatively by following instructions given on practice videos or from books. The actions of a backswing include swinging a golf club in progression from the address position through the backswing and finally to the top of the swing whilst ensuring correct position of the shoulders, hands and club-head. A golfer may develop a poor backswing in some instances, particularly without the guidance of an instructor. This may lead to the golf-club being swung above or below the correct plane which may result in an incorrect forward stroke and follow-through which results in poor golf shots being played.

It would therefore be desirable if at least some of the preferred embodiments of the present invention provide a training device which will allow a golfer to practice a correct backswing which will provide a correct "feel" enabling the golfer to improve his or her golf swing. It would also be desirable if at least some of the preferred embodiments of the invention provide a training device which is simple to use and may be used in the yard of a house or similar area. One purpose of the present application is to provide variations to and improvements upon the golf practice device of the present inventor's application WO2004/080546, the disclosure of which is imported herein by reference.

SUMMARY OF THE INVENTION

According to a first aspect of the present invention there is provided a golf swing training device comprising:

a first shoulder guide portion for guiding a first shoulder of a user during at least a part of a practice backswing; and a second shoulder guide portion for guiding a second shoulder of a user during at least a part of a practice backswing.

Preferably, the first shoulder guide portion is adapted to guide the first shoulder so that the first shoulder moves substantially in a first plane during said part of the backswing.

Preferably, the second shoulder guide portion is adapted to guide the second shoulder so that the first shoulder moves substantially in a second plane during said part of the backswing.

Preferably, the second plane is substantially parallel to the first plane.

Preferably, the second plane is offset from the first plane, in a direction perpendicular to the first and second planes, by a distance of between about 6 mm (¼ inch) and 100 mm (4 inches)

Preferably, the second plane is offset from the first plane, in a direction perpendicular to the first and second planes, by a distance of between 12 mm (½ inch) and 50 mm (2 inches).

Preferably, the second plane is offset from the first plane, in a direction perpendicular to the first and second planes, by a distance of between 20 mm (⅘ inch) and 25 mm (1 inch).

Preferably, there is provided means for adjusting the relative positions of the first and second shoulder guide portions in order to vary the relative positions and/or orientations of the first and second planes.

Preferably, the first shoulder guide portion is adapted to guide the first shoulder by providing a guide surface upon which the first shoulder can gently brush as a user performs a guided practice backswing.

Preferably, the guide surface of the first shoulder guide portion is generally planar.

Preferably, the second shoulder guide portion is adapted to guide the second shoulder by providing a guide surface upon which the second shoulder can gently brush as a user performs a guided practice backswing.

Preferably, the guide surface of the second shoulder guide portion is generally planar.

Preferably, the device comprises a curved club-head guiding portion for assisting a user to guide a golf club head through at least a portion of the backswing.

Preferably, the club head guiding portion is generally in the first plane.

Preferably, the club head guiding portion comprises a curved edge of a surface or panel.

Preferably, the curved club head guiding portion is retractable and/or detachable, for storage when not in use.

Preferably, the golf swing training device further comprises a support structure capable of supporting at least one of the first and second guide portions at a selectable angle of inclination.

Preferably, the support structure is capable of supporting both of the first and second guide portions at a selectable angle of inclination.

Preferably, the support structure comprises a platform upon which a person can stand when using the device.

Preferably, the support structure comprises a number of substantially rigid elements, pivotably connected together so that the support structure can be reconfigured between an extended working configuration and a compact storage configuration.

Preferably, the golf swing training device further comprises a stop member which prevents a user of the device from performing a golf swing, by substantially preventing passage of a golf club head into a follow through part of a golf swing.

According to a second aspect of the present invention there is provided a method of training a golfer to perform at least a substantial portion of a backswing, comprising:

providing a first shoulder guide portion for guiding a first shoulder of the golfer during at least a part of a practice backswing;

providing a second shoulder guide portion for guiding a second shoulder of a user during at least a part of a practice backswing.

According to a third aspect of the present invention there is provided a method of training a golfer to perform at least a substantial portion of a backswing, comprising:

instructing the golfer to move one of the golfer's shoulders in a first plane during at least part of the backswing;

instructing the golfer to move the other of the golfer's shoulders in a second plane substantially parallel to, and spaced apart from the first plane, during said at least part of the backswing;

providing means to allow the golfer to determine when the instructions are successfully followed.

According to a fourth aspect of the present invention there is provided a method of training a golfer to perform at least a substantial portion of a backswing comprising the step of providing a golf swing training device in accordance with the first aspect.

BRIEF DESCRIPTION OF THE DRAWINGS

Preferred embodiments of the invention will now be described by way of example only, with reference to the accompanying drawings in which:

FIG. 3*a* is a partial cross-sectional view on AA of FIG. 1;

FIG. 3*b* is a cross-sectional view on BB of FIG. 1;

PREFERRED EMBODIMENTS OF THE INVENTION

Figure 1:
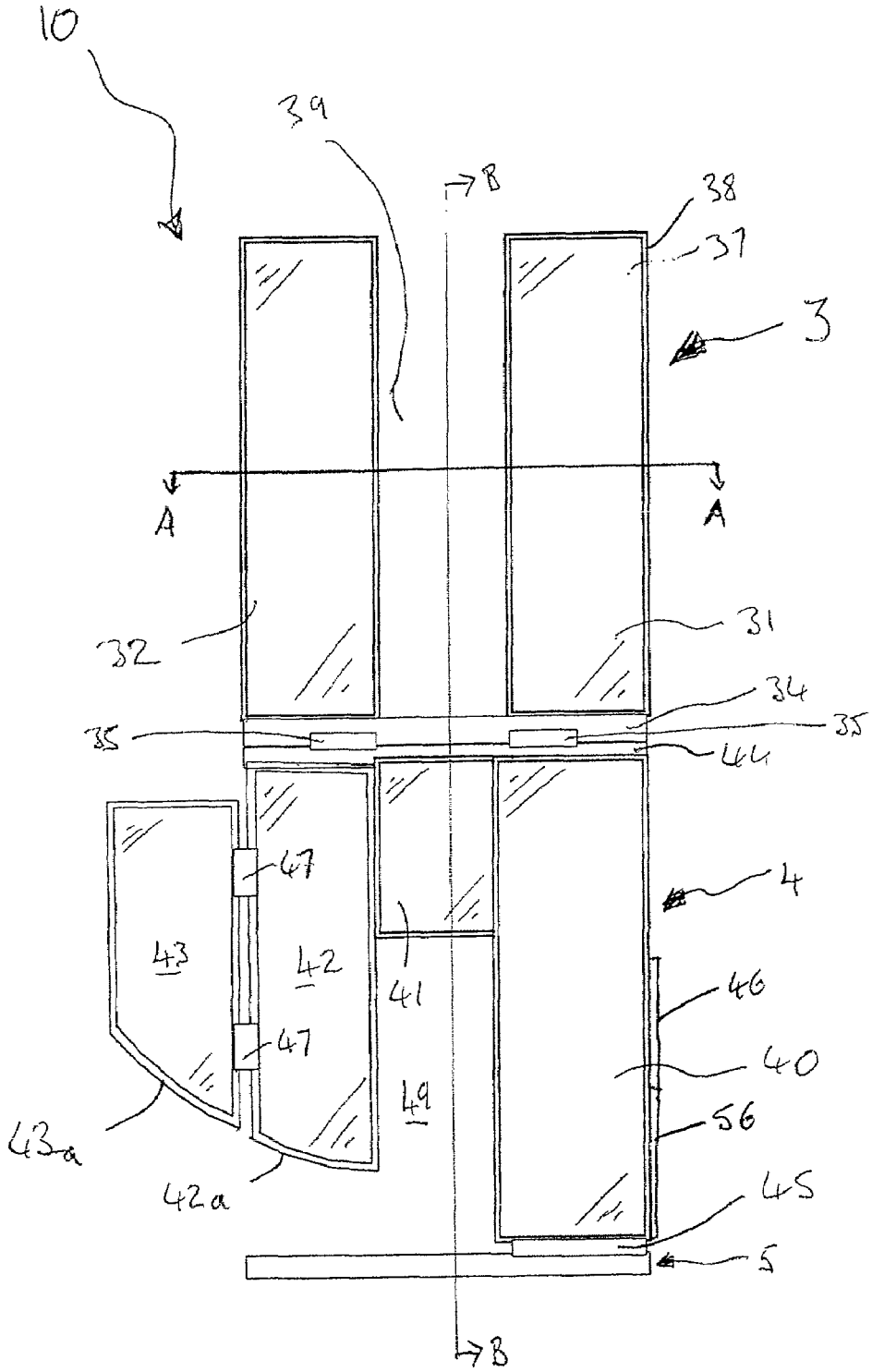
FIG. 1 is a front elevation of one preferred embodiment of a golf swing training device erected ready for use.

Referring to FIGS. 1, 2, 3*a* and 3*b*, an embodiment of a golf swing training device is indicated generally by the reference numeral 10 and is adapted to train a user 11 to use a correct backswing in a golf shot.

Figure 2:
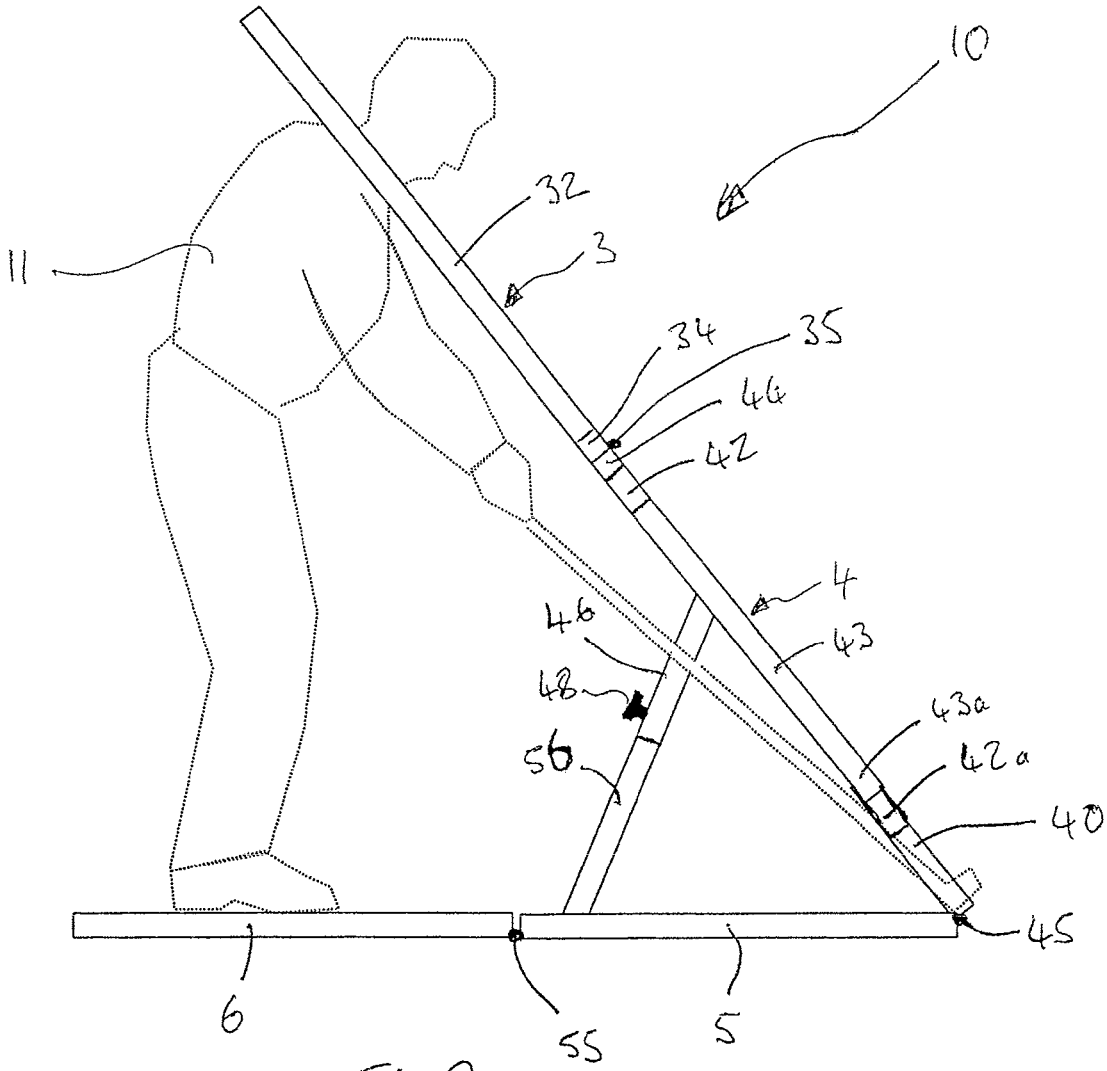
FIG. 2 is a side elevation of the golf swing training device of FIG. 1.

In this embodiment the device comprises four main panels, an upper inclined panel 3, a lower inclined panel 4, a first base panel 5 and a second base panel 6. As illustrated in FIGS. 1, 2 and 3*b*, in use the upper inclined panel serves to provide guide portions for guiding the shoulders of a user 11 during a practice backswing. The lower inclined panel 4 serves to support the upper inclined panel 3 relative to the first and second base panels 5,6 and is connected to the upper inclined panel by one or more first hinges 35 and to the first base panel by one or more second hinges 45. The first and second base panels 5, 6 serve to provide a sturdy base for the device. The first base panel is attached by the one or more second hinges 45 to the lower inclined panel at a front end of said first base panel 5 and is attached to the second base panel, by way of one or more third hinges 55 at a rear end of said first base panel 5. The upper and lower inclined panels 3,4 are hinged together so that in use they are substantially coplanar. The degree of inclination of the upper and lower inclined panels 3,4 can be controlled by supporting the lower inclined panel relative to the first base panel, and in the illustrated embodiment this is provided for by provision of an inclined panel support arm 46 pivotally attached to the lower inclined panel which engages in a telescopic arrangement with a base panel support arm 56 which is pivotally attached to the first base panel 5. The base panel support arm 56 is dimensioned so that part of the length thereof can fit within the inclined panel support arm 46. A support arm lock 48 is provided so that relative movement of the inclined panel support arm 46 and base panel support arm 56 can be prevented once the desired angle of inclination of the upper and lower inclined panels 3,4 is achieved.

The upper inclined panel 3 comprises a first shoulder guide panel 31 which in use provides a first shoulder guide portion for guiding a first shoulder of a user. The upper inclined panel 3 further comprises a second shoulder guide panel 32 which is similar to the first shoulder guide panel 31 but which is spaced apart therefrom so that the user may stand with a first shoulder contacting the first shoulder guide panel and a second shoulder contacting the second shoulder guide panel with the head and neck of the user protruding through the accommodating space 39 provided between the first and second shoulder guide panels 31,32. Each of the first and second shoulder guide panels comprises a generally rectangular frame (for example 38, 38*a* illustrated in relation to the first and second shoulder guide panels 31, 32, respectively) upon which is mounted a suitably sized sheet 37, 37*a* of a thin sheet material. As illustrated best in FIG. 3*a*, the sheets 37, 37*a* are mounted on what is, in use, the underside of the upper inclined panel, and are used to contact, and act as guides for, the shoulders of a user. The sheets 37, 37*a* may be attached to the respective frames 38, 38*a* by any suitable means, examples of which are by use of an adhesive or by use of a suitable fastening means such as rivets. The frame 38 may be made of any suitably rigid material and in a prototype device square section aluminium tubing is used (although it is envisaged that a suitable plastics material might be more suitable for mass production).

The first and second shoulder guide panels 31,32 are mounted at their lower ends to a shoulder guide support strut 34, which is substantially horizontal in use. This mounting provides a substantially rigid connection between each of the shoulder guide panels 31,32 and the shoulder guide support struts 34.

An important feature of this embodiment is that the sheet 37 which serves in use to guide the first shoulder of a user is not coplanar with the sheet 37*a* of the second shoulder guide panel 32 which serves in use to guide the second shoulder of the user. This important feature will be discussed in detail in due course.

The lower inclined panel comprises a main support panel 40 which is generally rectangular in shape and which is relatively tall compared to its width. The lower end of the main support panel 40 is attached to the first base panel 5 via the one or more hinges 45. The top end of the main support panel 40 is attached to a lower-panel 44 which is generally parallel to the shoulder guide support strut 34 and which is pivotally attached thereto by the one or more first hinges 35. The main support panel 40 therefore serves to support the upper inclined panel 3 relative to the first base panel 5. Although not strictly necessary to the shoulder guiding function of the golf swing training device 10, the lower inclined panel further includes a first club head guide panel 42 which depends downwardly from the lower panel upper strut 44 and which is provided with a lower curved edge 42*a* which serves as a guide for a golf club head and which in use is vertically spaced apart from the first base panel 5 to allow passage of a golf club head therebetween as a backswing is practiced. The first club head guide panel 42 is generally coplanar with, but spaced apart from the main support panel 40.

Depending downwardly, and inclined from, a central part of the lower panel upper strut 44 there is provided a lower central panel 41, which extends between the first club head guide panel 42 and the main support panel 40 in order to provide a stiffening effect for the lower inclined panel 4. The lower central panel 41 is shorter than the first club head guide panel 42 and the main support panel 40 so that between the lower parts of the first club head guide panel 42 and the main support panel 40 there is provided a club head space 49. Attached to a lateral side of the first club head guide panel 42 which is further from the club head space 49 there is provided an optional second club head guide panel 43 which has a lower edge 43*a* which serves as a club head guide, and which is curved to effectively extend the club head guide provided by the edge 42*a*, in use. The second club head guide panel 43 is attached to the first club head guide panel 42 by one or more fourth hinges 47. It will be appreciated that the second club head guide panel may be considered a somewhat optional feature and in some embodiments this may be omitted or detachable from the first club head guide panel. The first and second base panels 5,6 are provided to form a base in the form of a shallow platform upon which a user may stand (as illustrated in FIG. 2). This helps to provide stability for the swing training device.

In use, a user selects a club with which he wishes to practice a backswing and assumes a stance appropriate for addressing a golf ball (as if a golf ball were placed on, or a little above, the front and centre of the first base panel) using the selected club. The swing training device 10 is then adjusted so that the inclination of the upper and lower inclined panels 3, 4 is such that the user's shoulders gently contact the first and second shoulder guide panels 31, 32, so that the club head is close to the bottom edge of the main support panel 40 and so that the user's hands are spaced apart from the upper and lower inclined panels 3,4. The inventor has determined that at address, the shoulder corresponding to the "rearmost" hand of a golfer will be slightly lower than the shoulder corresponding to the foremost hand of the golfer. That is, a right-handed golfer whose left-hand side is pointed generally in the intended direction of play, will have his right shoulder slightly lower than his left shoulder. This occurs because the player's right hand will be further down the grip of the golf club than his left hand. The inventor has determined that not only is the rearmost shoulder slightly lower than the foremost shoulder when addressing the ball, but that for a normal golfer it aids development of an effective backswing to guide the motion of the shoulders in parallel slightly spaced apart planes, with each shoulder starting at the address position. (For a sample golfer it has been found that the planes should be displaced about 22 mm from each other, but this is likely to vary for different golfers with different stances and physiques.) Accordingly, the first shoulder guide panel 31, which is adapted to contact the left shoulder of a user as illustrated, is in this embodiment provided in a slightly higher plane than the second shoulder guide panel which is adapted to contact the right shoulder of the user. Accordingly, the user should be able to assume a correct address position with both shoulders in light contact with the respective shoulder guide panels and with his head extending through the accommodating space 39. When executing the correct backswing the shoulders of the user 11 remain in light contact with the respective shoulder guide panels 31,32. Therefore, each shoulder is guided in a respective plane by the respective shoulder guide panel. Guiding the shoulders in this way has been found to be an effective training method for learning a correct backswing, which is of great assistance in developing a good golf swing. Furthermore, it has been found to be beneficial to the backswing if the club head moves, during at least part of the beginning of the backswing, in substantially the same plane as at least one of the shoulders. To assist a user in achieving this, the first, and optionally the second, club head guide panels provide one or more guide edges which the user can use as a visual reference to ensure that the club head is remaining substantially in the correct plane. (There is an apparent tendency among golfers to pull the club head away from the correct plane in a backwards direction, and providing a visual reference to the correct plane has been found to assist in overcoming that tendency, and therefore in improving the backswing.) In variations of this embodiment other members (including for example curved telescopic or otherwise retractable, or detachable members) could be used instead of, or in addition to, the club head guide panels in order to assist in guiding the club head.

It has been found that a typical user will initially attempt to execute the backswing incorrectly and that this will cause deviation from the light contact between each shoulder and the respective shoulder guide panel. This deviation may constitute drawing the shoulder away from the shoulder guide panel or pressing the shoulder more firmly into the shoulder guide panel. At first, a user typically finds it difficult to maintain consistent light contact of both shoulders with the respective shoulder guide panels but with practice this can be achieved consistently and at that stage a typical user will have greatly improved the form of his backswing.

It will be appreciated that as illustrated it is not considered essential to the function of this embodiment to provide locking mechanisms to secure each pair of mutually hinged panels in the folded or unfolded configuration (with the exception of the connection between the lower inclined panel 4 and the first base panel 5 which must be lockable to allow the angle of incline to be controlled). This is because the positioning of the hinges and abutment of the panels of each hinged pair can be arranged to allow the panels to be at stable equilibrium in the desired positions. However, for safety reasons it is preferred to provide a lock or catch (not shown) at least to secure the upper and lower inclined panels in their end-to-end coplanar configuration (as illustrated in FIG. 2). Any suitable catch or releasable locking mechanism could be used (for example, an elongate locking member passing though aligned through-apertures in the shoulder guide support strut 34 and lower panel upper strut 44 could be used to prevent relative movement of the upper and lower inclined panels, and could be removed from the through apertures to allow relative movement).

Figure 4A:
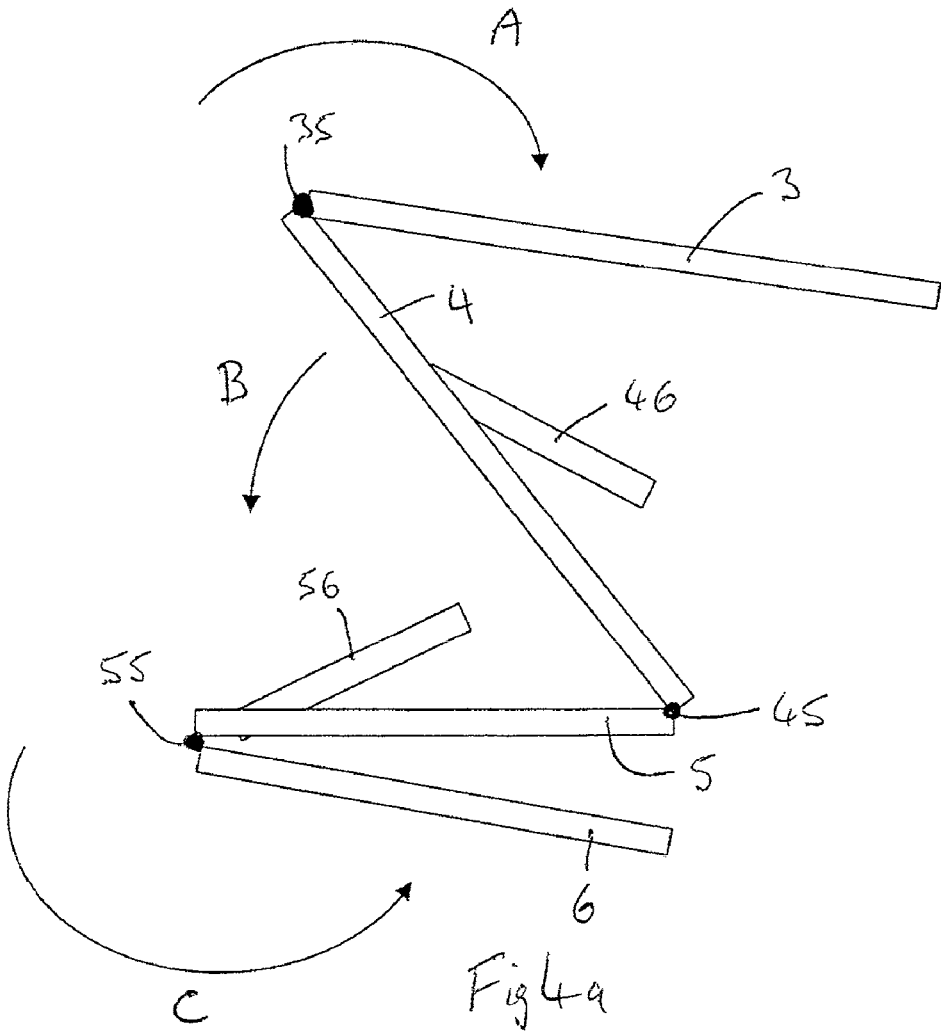
FIG. 4*a* is a schematic representation illustrating how the golf training device of FIGS. 1 to 3 can be folded into a storage configuration.
Figure 4B:
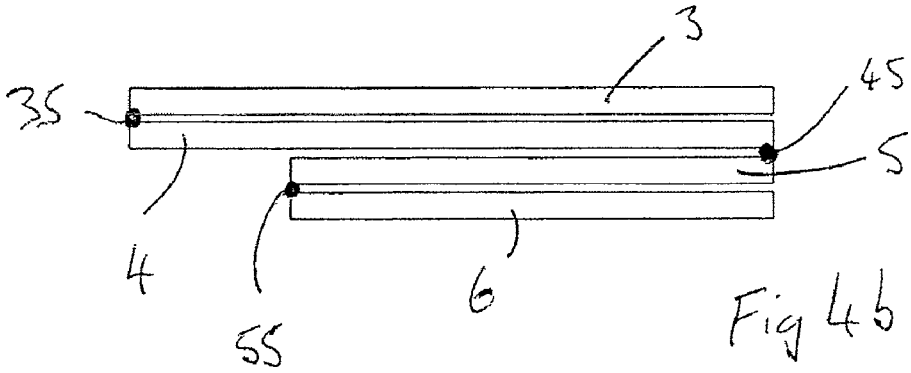
FIG. 4*b* is a schematic side elevation of the golf training device of FIGS. 1 to 3 folded into a compact storage configuration.

Because the upper inclined panel 3, lower inclined panel 4 first base panel 5 and second base panel 6 are connected to each other by the first, second and third sets of one or more hinges, despite the substantial size of the golf swing practice device 10 in use, it can be folded to a relatively compact size for storage and/or transportation. The folding of the device 10 can be understood by reference to FIG. 2 and FIGS. 4*a* and 4*b*. Referring to FIGS. 2 and 4*a*, to fold the device from its erected configuration, first the upper inclined panel 3 is rotated substantially 180 degrees about the one or more first hinges 35 (indicated by arrow A in FIG. 4*a*) so that it can rest upon the lower inclined panel 4 (after the release of any locking mechanism that would otherwise prevent this operation). Then the support arm lock 48 is released, and the angle of incline of the lower inclined panel 4 is released in order to separate the support arms 46, 56. The lower inclined panel 4 is rotated about second hinge 45 and laid upon first base panel 5 (indicated by arrow B in FIG. 4*a*). The second base panel 6 is then rotated substantially 180 degrees about the one or more third hinges 55 (indicated by arrow C in FIG. 4*a*) so that it contacts the first base panel. FIG. 4*b* shows the device schematically in its folded configuration. For clarity and simplicity the second club head guide panel 43 has not been mentioned in relation to the folding operation, but it will be appreciated that it could be detached, or folded on top of the first club head guide panel 42 prior to the described folding operations (and that, under the latter arrangement, the shape and dimensions of the upper inclined panel 3, lower inclined panel 4, and first hinge(s) 35 could be provided to allow stowage between the upper inclined panel 3 and lower inclined panel 4).

The various panels of the device 10, as illustrated, include sheet parts formed from a thin sheet material. The parts formed of sheet material are preferably made from a somewhat a rigid material such as sheet plywood, Perspex, fibreglass or any other material which may be suitable. A transparent sheet material such as Perspex is preferred since in use the user's head will be generally above the device and the remainder of the user will be generally below the device, and use of a transparent material avoids the sheet material unduly obscuring the user's view of elements of his own stance. The sheet material performs a useful function in the first and second shoulder guide panels 31, 32 since it provides surfaces for contacting the top of the user's shoulders. In the panels of the lower inclined panel 4 the use of a sheet material is less important, and if desired the sheet material could be omitted. However some benefits of using sheet material, as illustrated, in the lower inclined panel 4 are that: first, they help to avoid inadvertent passage of objects, such as golf clubs and users limbs, through the panels, and this presents a safety benefit, and (2) printed matter may be provided on the sheet material, which may, for example, aid in use of the device, provide information to assist in improving the user's golf skills, or be in the nature of advertising or promotional material.

It should be appreciated that many variations of the above embodiment are possible. For example, the upper and lower inclined panels could each be formed of a single panel, rather than the various sub-panels described above. The upper inclined panel could be provided by a planar sheet of material, with an aperture or slot to accommodate the user's head, with a surface to guide one shoulder being a surface of the sheet, and a surface for guiding the other shoulder being provided by a different part of the device such as a spacer member attached to the underside of the sheet. In some variations, separate shoulder guide parts of the device may be provided such that their relative positions may be adjusted allowing, for example, the distance between parallel guide planes to be set differently for different users. For example, the two shoulder guide parts could be connected by a structure including bolts, and a selection of spacers or washers could be provided to allow adjustment of the relative positions. It should also be noted that some embodiments which allow first and second shoulders to be guided in first and second parallel spaced apart planes, may also beneficially provide the option of allowing the first and second shoulders to be guided in one single plane. This option may be useful for golfers who wish to practice unorthodox golf swings.

Figure 5A:
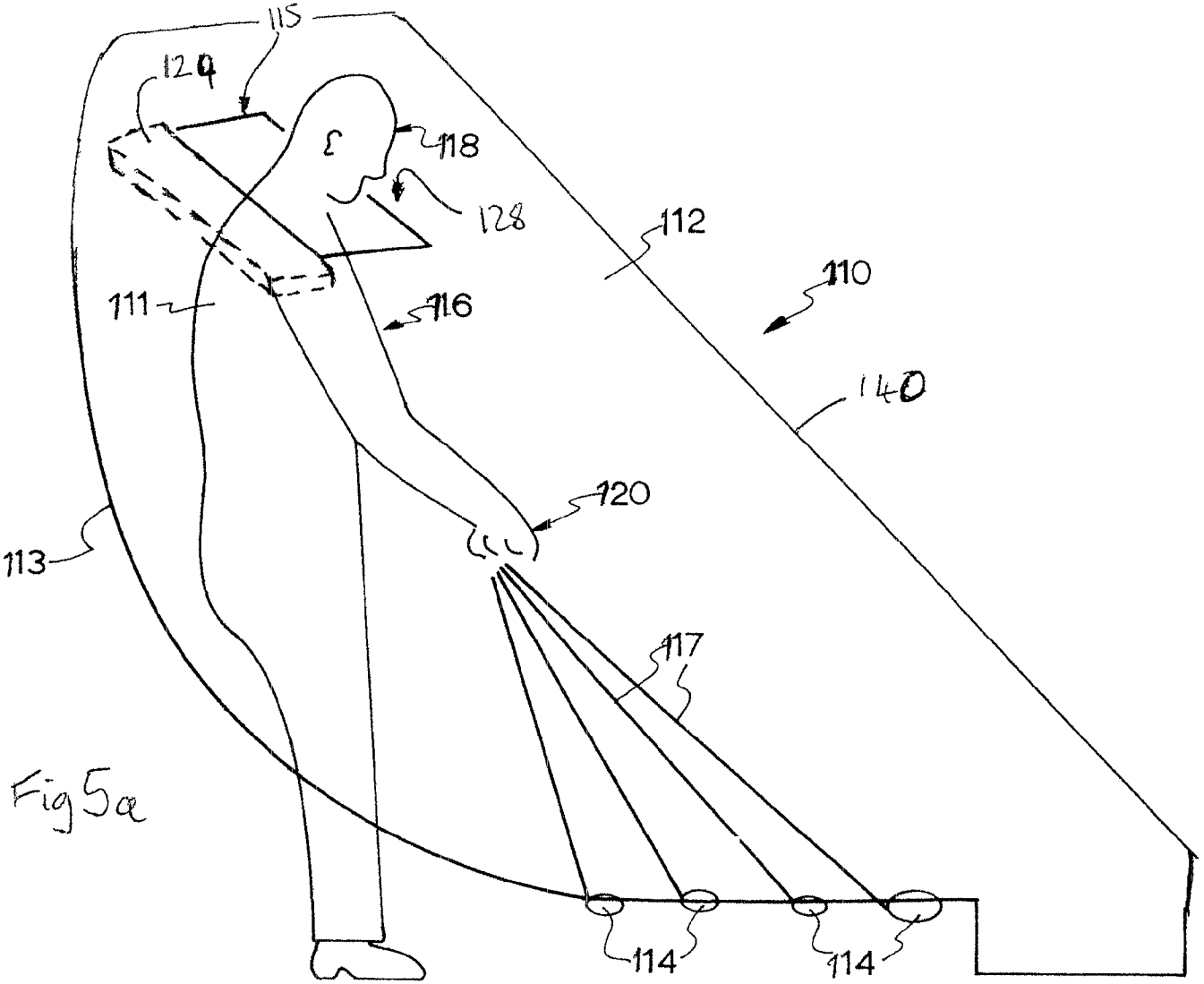
FIG. 5*a* is a schematic perspective illustration of an alternative embodiment of a golf training device.
Figure 5B:
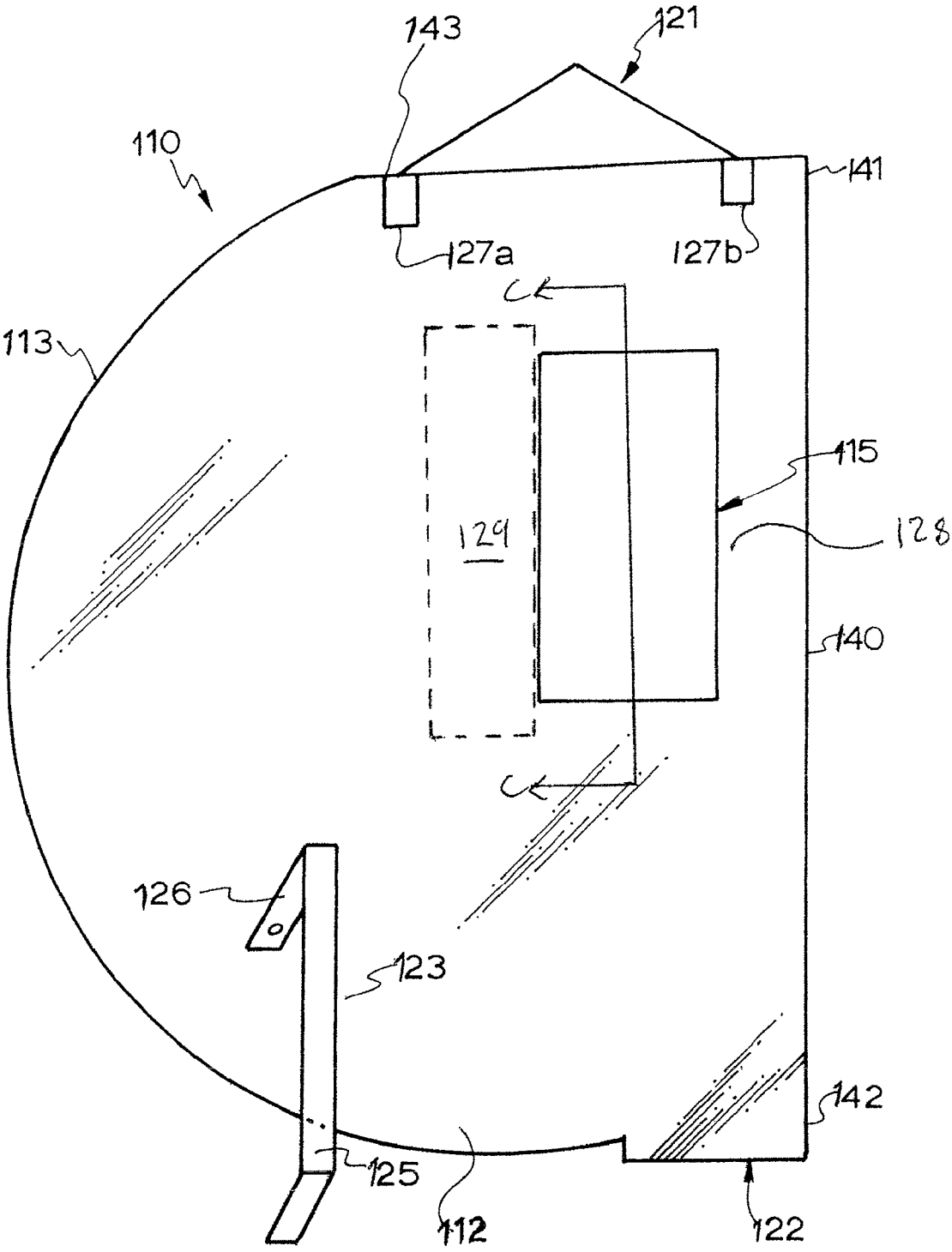
FIG. 5*b* is a front elevation of the golf training device of FIG. 5*a;*
Figure 5C:
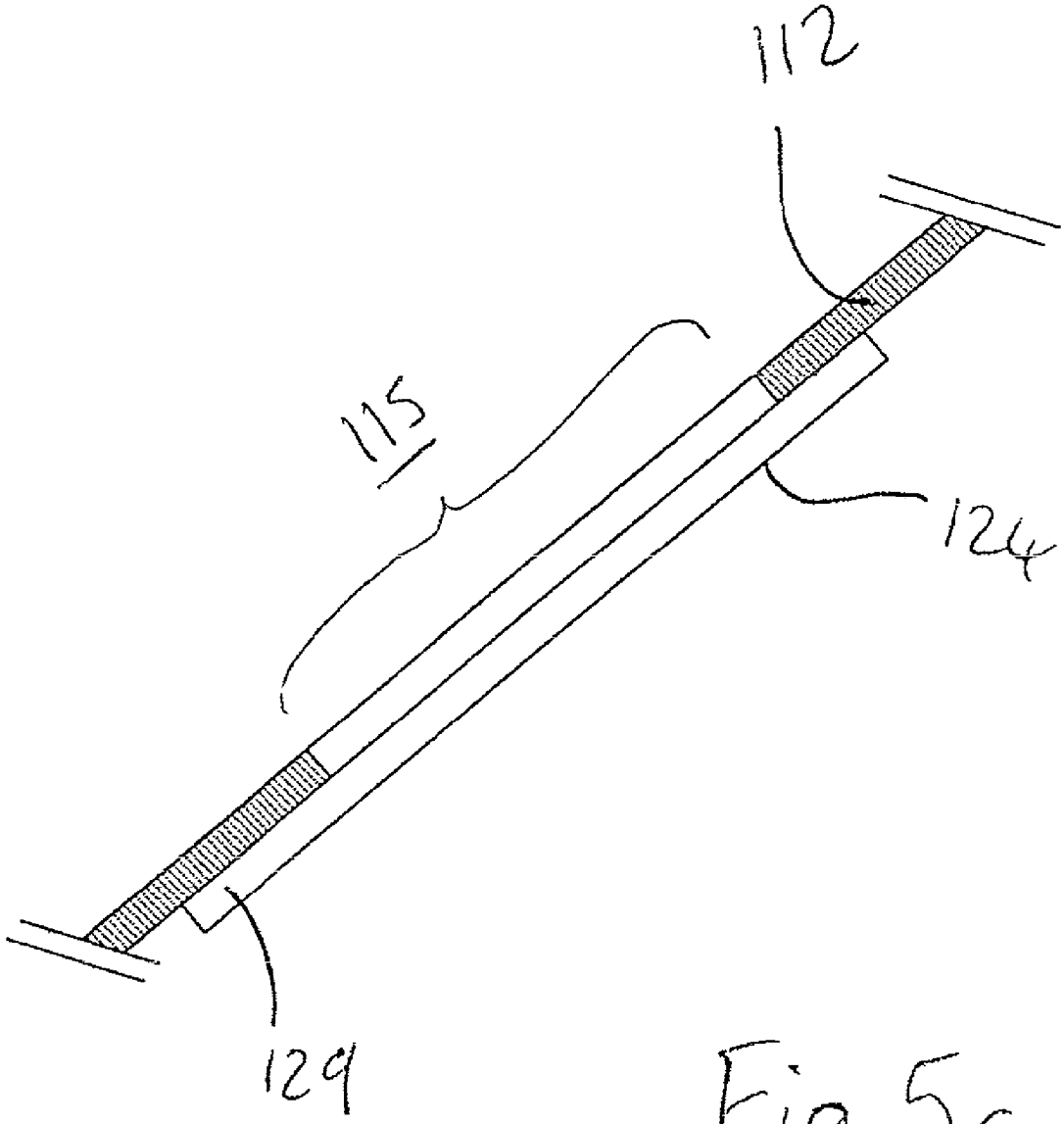
FIG. 5*c* is a partial cross-section on CC of FIG. 5*b;*

In an alternative embodiment, a golf practice device is based closely upon the golf practice device described as a preferred embodiment of application WO2004/080546, in that it is based on a substantially continuous sheet of material. As shown in FIGS. 5*a*, 5*b* and 5*c*, an embodiment of a golf practice device, generally designated 110, comprises a sheet 112 of material which has a first straight edge 140 and an opposing arcuate edge 113. The first straight edge 140 is connected at its first end 141 by a second straight edge 143 to a first end of the arcuate edge 113. The first straight edge 140 is also connected at its second end 142 to a second end of the arcuate edge 113 by a foot 122. In use, the sheet is inclined so that the respective first ends of the first straight edge 140 and arcuate edge 113 are higher than the respective second ends. The foot 122 is shorter in length than the length of the second straight edge 143. The arcuate edge 113 is approximately a semicircular.

The device 110 also includes an aperture 115 in the sheet 112 through which the head 118 of the user 111 may pass. The aperture 115 is located in the sheet 112 towards the first end 141 of the first straight edge 140, and proximate to the edge of the sheet 112 defined by the first straight edge 140. The aperture 115 indicates the correct position for the user to stand relative to the device so that he or she may practice the correct backswing. A part 128 of the underside of the sheet 112 adjacent to, and on a first side of, the aperture 115 acts as a first shoulder guide, for guiding the leading shoulder of the user (which is, at address, higher than the following shoulder). Adjacent the aperture 115, on a second side (opposite to the first side) thereof, there is provided a following-shoulder guide 129 which comprises a strip or block of material attached to the underside of the sheet 112 and providing a generally planar lower surface 124 in a plane parallel to, but spaced apart from, the plane of the underside of the sheet. In use the planar lower surface is for lightly contacting the top of the following shoulder of the user. Thus, although based upon a continuous, large, substantially planar sheet, this embodiment provides first and second shoulder guides in parallel but slightly spaced apart planes.

FIG. 5*b* in particular shows various support means for the device 110. Attachment member 121, for example in the form of a wire, cable or chord, connected to the device 110 at reinforced attachment points 127*a* and 127*b*, is adapted to allow the device 110 to be hung to the side of a wall, clothesline, tree or similar support. At the other end of the device 110 is a foot 122 which is adapted to rest on the ground. The foot 122 may be secured to the ground by a number of anchor pegs (not shown) or similar such means. Likewise, the foot 122 may be secured by the addition of a suitable weight to prevent it from moving significantly. The device 110 is also provided with a spacing member 123 which acts to space apart the arcuate edge 113 from the ground. The spacing member 123 is attached to the upper surface of the sheet 112 via a first portion 126. The first portion 126 extends away from the sheet 112, approximately perpendicular to the sheet 112. A generally L-shaped second portion 125 of the spacing member 123 is connected to the first portion 126. In use, the second portion 125 passes over and is spaced apart from the arcuate edge 113 and rests upon, and may be secured to, the ground. The second portion may be secured to the ground using anchor pegs as described for the foot 122 above. The first portion 126 of the spacing member 123 is adapted to support the sheet 112 while enabling the spacing member 123 to maintain a clearance from the arcuate edge 113. This enables the club-head to pass the spacing member 123 during the backswing.

The device 110 is set up for use by engaging the foot 122 and the support piece 123 with the ground and by coupling the attachment member 121 with the side of a wall, clothesline, tree or similar support. In use, the club (and thus the club-head), at the top of the backswing, pass under the attachment member 121. With reference to the correct address of the individual user 111, with the user's head 118 extending through the aperture 115, the height at which the attachment member 121 is coupled to the support and/or the length of the attachment member 121 is adjusted so that the sheet 112 is angled correctly, that is, so that sheet 112 is substantially in the correct plane. That is, so that when the user stands at address, the part 128 of the underside of the sheet 112 lightly contacts the top of the user's leading shoulder (not shown), and the planar surface 124, lightly contacts the top of the user's following shoulder, and so that an appropriate part of the arcuate edge 113 is at (or at least close to) the position of the head 114 of the club 117 at address. Whilst the process of setting the device to the appropriate angle might require assistance from another person, once the device 110 has been set-up, it can be left ready for use on a semi-permanent basis.

Once set up, the device 110 can be used in a similar manner to the device 10 described above. It will be appreciated that the embodiment 10 is currently considered preferable to the embodiment 110, because it is relatively portable, can be folded for storage, is self-supporting without reliance on hanging from a fixed support, and is suitable for use indoors and/or on a hard flooring surface since it does not require pegging to the ground.

Figure 6A:
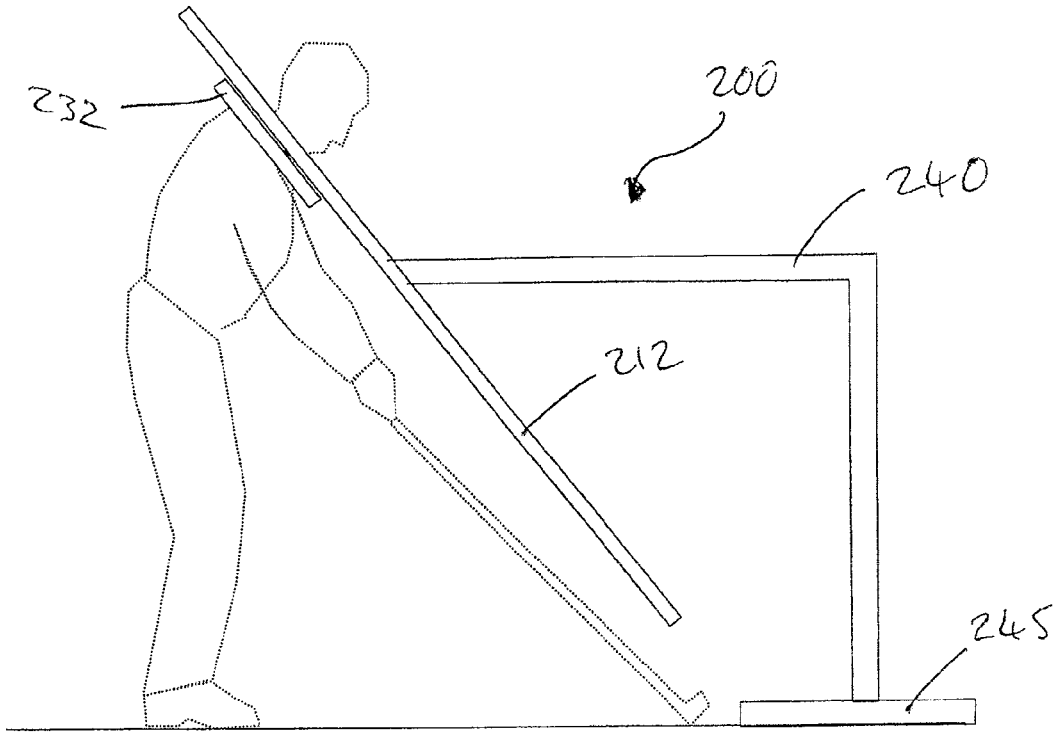
FIG. 6*a* is a schematic side elevation of a further alternative embodiment of a golf training device.
Figure 6B:
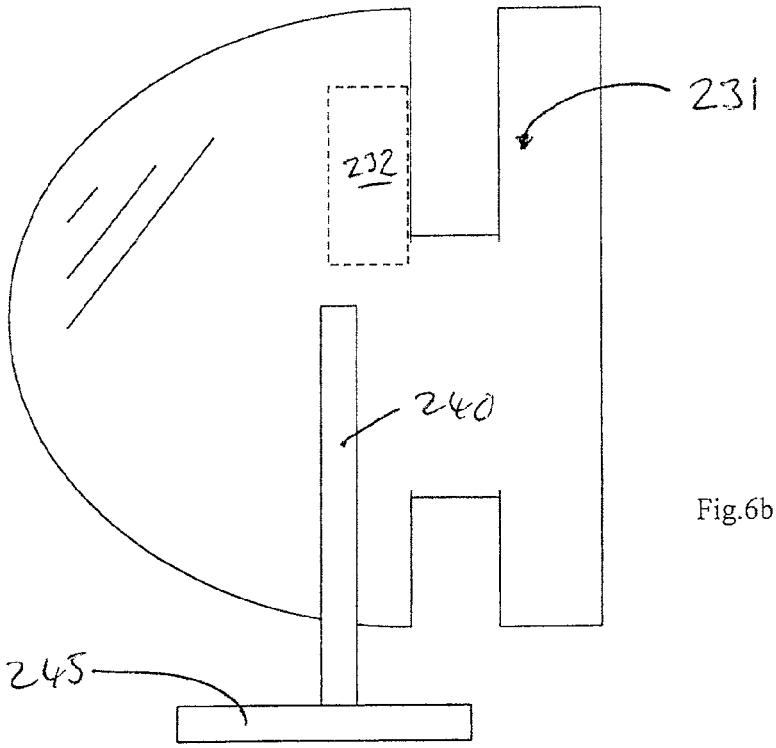
FIG. 6*b* is a schematic front elevation of the golf training device of FIG. 6*a*.

A further alternative embodiment may adopt a cantilevered support arrangement for supporting the shoulder guides. By way of example, FIGS. 6*a* and 6*b* show an embodiment of a golf swing training device 200 in which a large generally planar panel 212 provides a first shoulder guiding portion 231 and supports a second shoulder guiding portion 232 in the form of a spacer attached to the underside of the panel 212. The panel 212 is supported above the ground by a support arm 240, which is attached to a suitably heavy base 245 located a convenient distance in front of the panel 212. The connection (not shown) between the support arm 240 and the panel 212 is of a type that allows the angle of inclination of the panel to be set as required. Many such means of connection are known per se, and are available as options to the skilled addressee.

The described preferred embodiments thus provide structurally simple, economically viable devices for helping a user correctly position his shoulders (and, especially where a club head guide is provided, to assist in positioning of the club head and hands) while executing a practice backswing.

Of course, many variations and alternative embodiments to those illustrated will be apparent to those skilled in the art. For example, the shoulder guides can be provided by suitably inclined and positioned parts of many structures other than those illustrated, and could be supported by a stand positioned behind the user (in which case the connection between the stand and the shoulder guides would preferably be on the lead-hand side of the user to avoid interference with the backswing).

In particular, it will be appreciated that embodiments which are based on the golf swing training device 10 of FIGS. 1 to 4*b* may include features, or variants of features, of the golf swing training device 200 of FIGS. 5*a* and 5*b*.

For example, in one alternative, the club head guide panel 43 of the golf swing training device 10 could be replaced by a larger panel which provides a much longer curved edge (than the edge 43*a*) and which therefore provides a club head guide guides the club head through a greater part of the backswing (than does the edge 43*a*). Some examples of this type of embodiment might be considered to have a club head guiding edge more closely related to the arcuate edge 113, than to the panel edge 43*a*. A panel (analogous to an enlarged version of panel 43) might be made from a plurality of panels foldable attached together, and might, for convenience in transportation, be detachable from the remainder of the golf swing training device. In a further alternative an embodiment similar to the golf swing training device 10 could be provided with a stabilising support, similar to the spacing member 123, in order to provide additional stability for the rear foot side of the device. Such a stabilising support should be arranged so that it does not impede the club head during the practice backswing. It is therefore preferred that such a stabilising support have a first end portion attached to the upper surface of a panel, an intermediate portion that extends away from the panel and which passes above and is spaced apart from the panel edge, and a second end portion which contacts a supportive base, such as the ground or a device base (perhaps corresponding to the first base panel 5 of the golf swing training device 10). Such a stabilising support could attach to the device base by a pivotable connection, to facilitate the transition between storage and working configurations, could be adapted to disengage the base or could be configured in any other appropriate manner.

In the claims which follow and in the preceding description of the invention, except where the context requires otherwise due to express language or necessary implication, the word "comprise" or variations such as "comprises" or "comprising" is used in an inclusive sense, ie. to specify the presence of the stated features but not to preclude the presence or addition of further features in various embodiments of the invention.

It is to be understood that, if any prior publication is referred to herein, such reference does not constitute an admission that the publication forms a part of the common general knowledge in the art, in Australia or in any other country.

Modifications and improvements may be incorporated without departing from the scope of the present invention.

The invention claimed is:

1. A golf swing training device comprising:

a first shoulder guide portion for guiding a first shoulder of a user during at least a part of a practice backswing; and a second shoulder guide portion for guiding a second shoulder of a user during at least a part of a practice backswing;

wherein said first shoulder guide portion defines a first inclined plane and is arranged to guide the first shoulder so that the first shoulder moves substantially in said first plane during said part of the backswing;

wherein said second shoulder guide portion defines a second inclined plane and is arranged to guide the second shoulder so that the second shoulder moves substantially in said second plane during said part of the backswing; and, wherein said second plane is offset from, and substantially parallel to the first plane.

2. A golf swing training device as claimed in claim 1, wherein said second plane is offset from said first plane, in a direction perpendicular to said first and second planes, by a distance of between about 6 mm (¼ inch) and 100 mm (4 inches).

3. A golf swing training device as claimed in claim 2, wherein the second plane is offset from the first plane by a distance of between 12 mm (½ inch) and 50 mm (2 inches).

4. A golf swing training device as claimed in claim 3, wherein the second plane is offset from the first plane by a distance of between 20 mm (⅘ inch) and 25 mm (1 inch).

5. A golf swing training device as claimed in claim 1, wherein there is provided at least one adjustable part thereof for adjusting the relative positions of the first and second shoulder guide portions in order to vary the relative positions and/or the orientations of the first and second planes.

6. A golf swing training device as claimed in claim 1, wherein the first shoulder guide portion guides the first shoulder by providing a guide surface upon which the first shoulder gently brushes as a user performs a guided practice backswing.

7. A golf swing training device as claimed in claim 6, wherein the guide surface of the first shoulder guide portion is generally planar.

8. A golf swing training device as claimed in claim 6, wherein the second shoulder guide portion guides the second shoulder by providing a guide surface upon which the second shoulder gently brushes as a user performs a guided practice backswing.

9. A golf swing training device as claimed in claim 8, wherein the guide surface of the second shoulder guide portion is generally planar.

10. A golf swing training device as claimed in claim 1, wherein the device comprises a curved club-head guiding portion for assisting a user to guide a golf club head through at least a portion of the backswing.

11. A golf swing training device as claimed in claim 10, wherein the club head guiding portion is generally in the first plane.

12. A golf swing training device as claimed in claim 10, wherein the club head guiding portion comprises a curved edge of a surface or panel.

13. A golf swing training device as claimed in claim 10, wherein the curved club head guiding portion is retractable and/or detachable, for storage when not in use.

14. A golf swing training device as claimed in claim 1, further comprising a support structure capable of supporting at least one of the first and second guide portions at a selectable angle of inclination.

15. A golf swing training device as claimed in claim 14, wherein the support structure is capable of supporting both of the first and second guide portions at a selectable angle of inclination.

16. A golf swing training device as claimed in claim 14, wherein the support structure comprises a platform upon which a person can stand when using the device.

17. A golf swing training device as claimed in claim 14, wherein the support structure comprises a number of substantially rigid elements, pivotably connected together so that the support structure can be reconfigured between an extended working configuration and a compact storage configuration.

18. A golf swing training device as claimed in claim 1, further comprising stop member which prevents a user of the device from performing a golf swing, by substantially preventing passage of a golf club head into a follow through part of a golf swing.

19. A method of training a golfer to perform at least a substantial portion of a backswing, comprising:

providing a first shoulder guide portion for guiding a first shoulder of the golfer during at least a part of a practice backswing so that the first shoulder is guided to move substantially in a first plane during said part of said backswing;

providing a second shoulder guide portion for guiding a second shoulder of a user during at least a part of a practice backswing so that the second shoulder is guided to move substantially in a second plane during said part of said backswing; and wherein said second plane is offset from and substantially parallel to said first plane.

20. A method of training a golfer to perform at least a substantial portion of a backswing, comprising:

instructing the golfer to move one of the golfer's shoulders in a first inclined plane during at least part of the backswing;

instructing the golfer to move the other of the golfer's shoulders in a second plane substantially parallel to, and spaced apart from the first plane, during said at least part of the backswing;

providing respective shoulder guides to allow the golfer to determine when the instructions are successfully followed.

21. A method as claimed in claim 20 wherein the respective shoulder guides are provided by a golf swing training device comprising:

a first shoulder guide portion for guiding the first shoulder of the golfer during at least a part of the backswing so that the golfer can determine whether the first shoulder moves substantially in said first plane during said part of the backswing; and a second shoulder guide portion for guiding the second shoulder of the golfer during at least a part of the backswing so that the golfer can determine whether the second shoulder moves substantially in the second plane during said part of the backswing.

* * * * *